US009027494B2

(12) United States Patent
Watkins

(10) Patent No.: US 9,027,494 B2
(45) Date of Patent: May 12, 2015

(54) JET BOAT INCLUDING ARTICULATING KEEL

(71) Applicant: Yamaha Motor Corporation, USA, Cypress, CA (US)

(72) Inventor: Scott Watkins, Canton, GA (US)

(73) Assignee: Yamaha Motor Corporation, USA, Cypress, CA (US)

( * ) Notice: Subject to any disclaimer, the term of this patent is extended or adjusted under 35 U.S.C. 154(b) by 133 days.

(21) Appl. No.: 13/678,860

(22) Filed: Nov. 16, 2012

(65) Prior Publication Data

US 2014/0137783 A1 May 22, 2014

(51) Int. Cl.

| | |
|---|---|
| ***B63H 11/117*** | (2006.01) |
| ***B63B 3/38*** | (2006.01) |
| ***B63H 25/38*** | (2006.01) |
| *B63H 11/00* | (2006.01) |
| *B63B 1/20* | (2006.01) |

(52) U.S. Cl.

CPC . *B63B 3/38* (2013.01); *B63H 11/00* (2013.01); *B63H 25/38* (2013.01); *B63B 2001/201* (2013.01)

(58) Field of Classification Search

CPC .... B63H 11/113; B63H 25/382; B63H 25/38; B63H 2025/063; B63H 2025/066; B63B 41/00; B63B 3/38; B63B 2001/201

USPC ..... 114/55.5, 55.51, 55.52, 140, 149, 162, 114/167; 440/43, 38

See application file for complete search history.

(56) References Cited

U.S. PATENT DOCUMENTS

| | | | | |
|---|---|---|---|---|
| 3,108,561 | A * | 10/1963 | McNeil et al. | 114/290 |
| 3,906,885 | A | 9/1975 | Woodfill | |
| 3,943,876 | A * | 3/1976 | Kiekhaefer | 440/43 |
| 3,976,026 | A * | 8/1976 | Eastling | 440/41 |
| 4,815,995 | A * | 3/1989 | Ingvason | 440/66 |
| 5,378,179 | A * | 1/1995 | Riggle | 440/62 |
| 5,605,110 | A * | 2/1997 | Talbot | 114/248 |
| 7,240,632 | B1 * | 7/2007 | Wynne et al. | 114/140 |
| 2003/0176120 | A1 * | 9/2003 | Walkowiak | 440/43 |

FOREIGN PATENT DOCUMENTS

JP 10-297595 A 11/1998

* cited by examiner

*Primary Examiner* — S. Joseph Morano
*Assistant Examiner* — Anthony Wiest
(74) *Attorney, Agent, or Firm* — Keating & Bennett, LLP

(57) ABSTRACT

A jet boat including a hull including a keel extending in a fore and aft direction of the jet boat, at least one jet propulsion nozzle mounted to a rear of the hull, and an articulating keel attached at the rear of the hull, the articulating keel arranged to pivot about a pivot axis extending vertically or substantially vertically. A bottom surface of the articulating keel does not extend below a bottom surface of the keel when the articulating keel is parallel or substantially parallel to the fore and aft direction of the jet boat.

17 Claims, 6 Drawing Sheets

JET BOAT INCLUDING ARTICULATING KEEL

BACKGROUND OF THE INVENTION

1. Field of the Invention

The present invention relates to a jet boat. More specifically, the present invention relates to a jet boat including an articulating keel that assists steering the jet boat.

2. Description of the Related Art

Jet boats typically use thrust to steer the jet boat by changing the direction of the thrust from one or more jet propulsion nozzles mounted at the rear of the jet boat. FIG. 2 is a rear view of a hull 55 of a conventional jet boat 50. The jet propulsion nozzles 51 are pivoted to the left or to the right to steer the jet boat 50 to the left or to the right, respectively. In order for the conventional jet boat 50 to track a straight line on the surface of the water, it is necessary for the operator of the conventional jet boat 50 to constantly ensure the jet propulsion nozzles 51 are parallel to a fore and aft direction of the conventional jet boat 50. This is because, as seen in FIG. 2, a rear of the hull 55 of the conventional jet boat 50 typically has a flat bottom surface. That is, the hull 55 of the conventional jet boat 50 typically does not include a keel extending along a lowermost portion of the hull 55.

Some jet boats incorporate a rudder that extends below the bottom surface of a hull of the jet boat to assist steering the jet boat by deflecting the flow of water passing under the bottom surface of the hull. Sometimes, the rudder is connected to the jet propulsion nozzle and extends downward from the jet propulsion nozzle to a location below the bottom surface of the hull.

Since the rudder extends below the bottom surface of the hull, the rudder is vulnerable to hitting objects in the water or even the ground when the jet boat is traveling in shallow water. This can damage the rudder. If the rudder is connected to the jet propulsion nozzle, it is possible that the jet propulsion nozzle is also damaged when the rudder hits an object in the water or the ground.

SUMMARY OF THE INVENTION

To overcome the problems described above, preferred embodiments of the present invention provide a jet boat including a keel with an articulating keel portion.

A jet boat according to a first preferred embodiment of the present invention includes a hull including a keel extending in a fore and aft direction of the jet boat, at least one jet propulsion nozzle mounted to a rear of the hull, and an articulating keel attached at the rear of the hull, the articulating keel arranged to pivot about a pivot axis extending vertically or substantially vertically. A bottom surface of the articulating keel does not extend below a bottom surface of the keel when the articulating keel is parallel or substantially parallel to the fore and aft direction of the jet boat.

At least a rear portion of the keel preferably includes sides extending upward from the bottom surface of the keel, and when the articulating keel is pivoted to the left or to the right about the pivot axis, at least a portion of the bottom surface of the articulating keel is preferably located below the sides of the keel so as to deflect water passing under the sides of the keel. The sides of the keel are preferably concave curved, and at least the rear portion of the keel preferably has a V-shaped cross-section. The concave curved sides of the keel are preferably longer as the keel extends rearward in the fore and aft direction of the jet boat. The concave curved sides of the keel preferably become more curved as the keel extends rearward in the fore and aft direction of the jet boat.

The bottom surface of the articulating keel is preferably located at a same height as the bottom surface of the keel. The bottom surface of the articulating keel is preferably located at a height that is above the bottom surface of the keel. The articulating keel preferably has a shape that is flat or substantially flat. The articulating keel preferably has a shape that corresponds to a shape of a rear portion of the keel.

The at least one jet propulsion nozzle preferably includes a first jet propulsion nozzle and a second jet propulsion nozzle mounted to the rear of the hull. The first and second jet propulsion nozzles preferably are disposed at a port side and a starboard side of the jet boat, respectively. The articulating keel is preferably disposed in between the first and second jet propulsion nozzles in a width direction of the jet boat.

The jet boat further preferably includes a hull bracket arranged to attach the articulating keel to the rear of the hull.

The jet boat further preferably includes a steering system arranged pivot the articulating keel about the pivot axis. The steering system preferably includes at least one lever attached to the articulating keel, a linkage connected to the at least one lever, and a steering device connected to the linkage. The linkage preferably includes a cable. The steering device preferably includes a steering wheel.

The jet boat further preferably includes a steering system arranged to simultaneously pivot both the at least one jet propulsion nozzle and the articulating keel.

The jet boat further preferably includes an articulating keel steering system arranged to pivot the articulating keel about the pivot axis and a nozzle steering system arranged to pivot the at least one jet propulsion nozzle. The articulating keel steering system is preferably separate from the nozzle steering system.

The pivot axis is preferably forward of the articulating keel. The pivot axis preferably extends through the articulating keel. The articulating keel preferably includes a portion that extends forward of the pivot axis.

The above and other features, elements, characteristics, configurations, arrangements and advantages of the present invention will become more apparent from the following detailed description of preferred embodiments of the present invention with reference to the attached drawings.

DETAILED DESCRIPTION OF PREFERRED EMBODIMENTS

Figure 1:
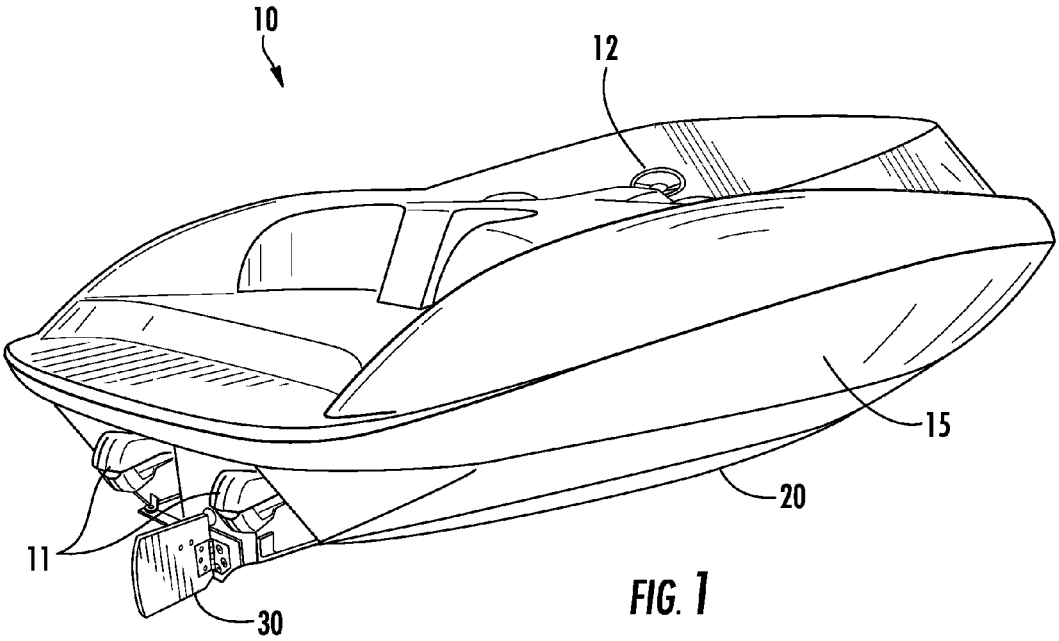
FIG. 1 is a perspective side view of a jet boat according to a preferred embodiment of the present invention.
Figure 2:
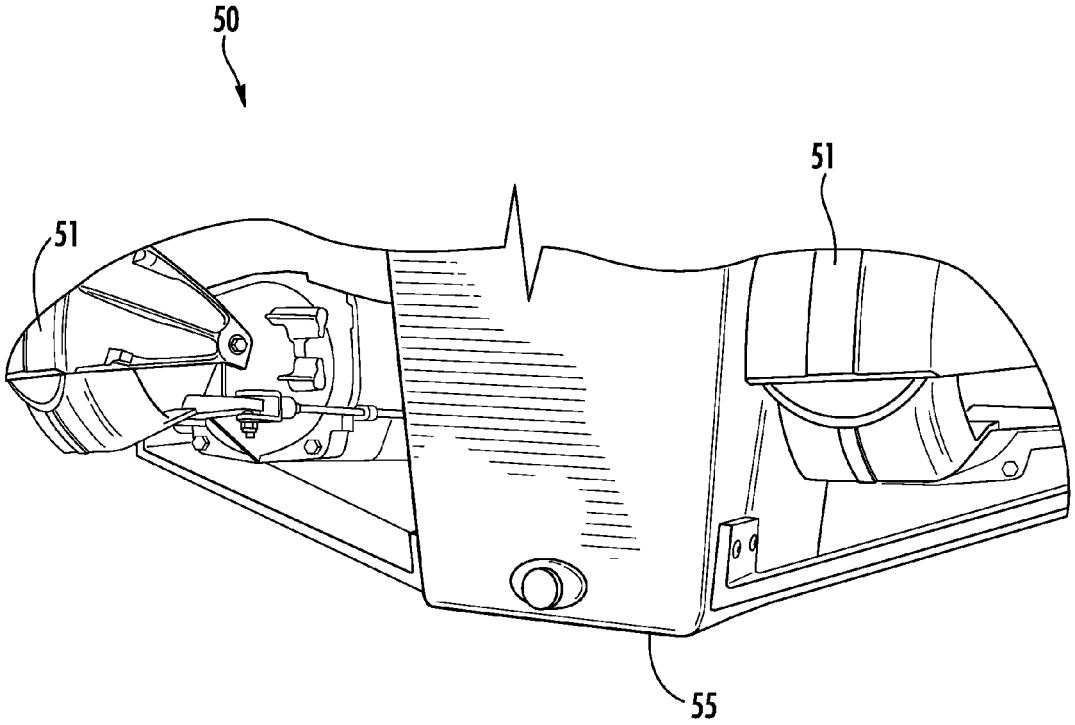
FIG. 2 (PRIOR ART)
FIG. 2 is a rear view of the stern of a conventional jet boat.

FIG. 1 shows a jet boat 10 according to a preferred embodiment of the present invention. The jet boat 10 includes a hull 15 and two jet propulsion nozzles 11 mounted at the rear of the hull 15. The jet propulsion nozzles 11 jet water rearward of the jet boat 10 to provide thrust for the jet boat 10. In the present preferred embodiment, the jet boat 10 preferably includes two jet propulsion nozzles 11, for example. A first jet propulsion nozzle 11 is disposed at a port side of the jet boat 10 and a second jet propulsion nozzle 11 is disposed at a starboard side of the jet boat 10. However, the jet boat 10 may include a single jet propulsion nozzle or more than two jet propulsion nozzles.

Figure 3:
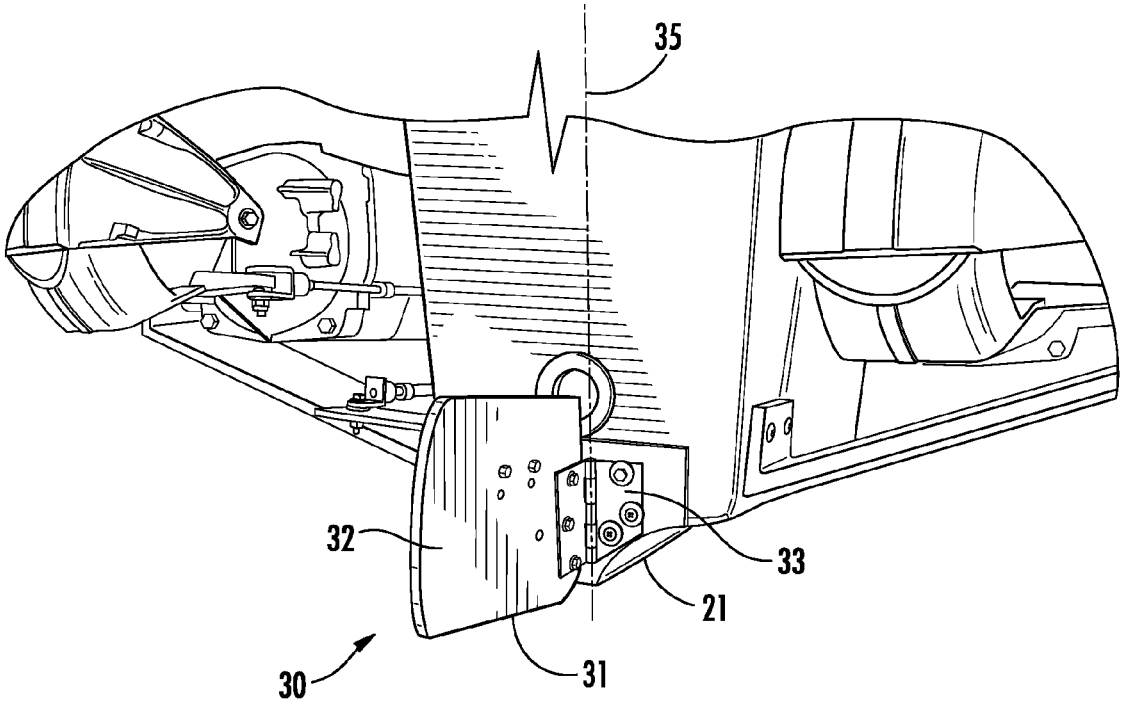
FIG. 3 is a rear view of the stern of the jet boat according to a preferred embodiment of the present invention.
Figure 4:
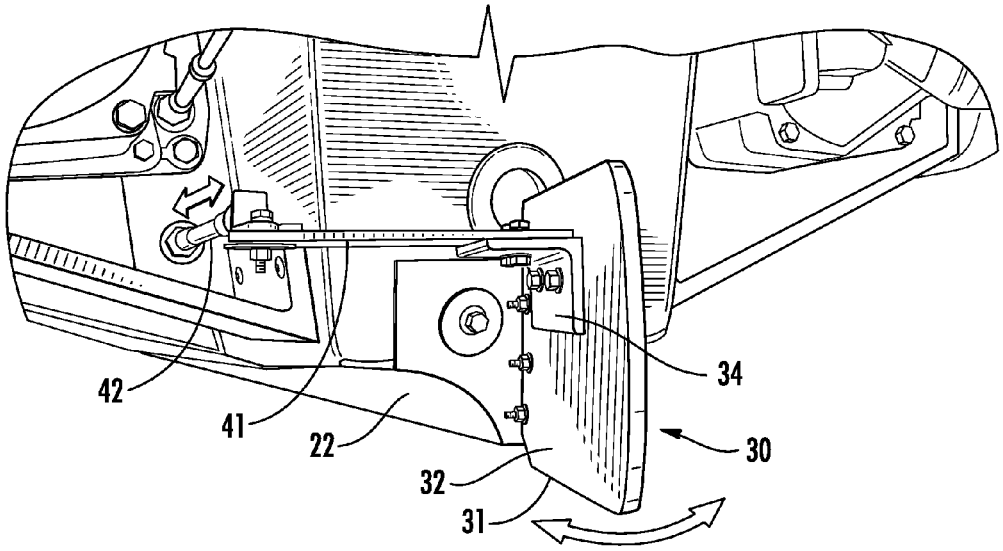
FIG. 4 is a perspective rear view of the stern of the jet boat according to a preferred embodiment of the present invention.

As show in FIGS. 1, 3, and 4, the hull 15 of the jet boat 10 includes a keel 20 that extends in the fore and aft direction of jet boat 10. The keel 20 extends along a middle of the hull 15 in the width direction of the jet boat 10 and defines a lowermost portion of the hull 15. The keel 20 may be manufactured simultaneously with the hull 15 such that the keel 20 is unitary with the hull 15. Alternatively, the keel 20 may be manufactured separately from the hull 15 and connected to the hull 15 after the hull 15 has been manufactured. The keel 20 preferably extends along the entire length of the lowermost portion of the hull 15. Alternatively, the keel 20 may start at a point rearward from a forward most portion of the hull 15 and extend to the rear of the hull 15.

As shown in FIGS. 3 and 4, the keel 20 includes a bottom surface 21 and sides 22 extending upward from the bottom surface 21. At least a rear portion of the keel 20 has a V-shaped cross-section. Preferably, the sides 22 of the keel 20 are concave curved. Alternatively, the sides 22 of the keel may be straight, convex curved, or any other suitable shape. Preferably, the keel 20 becomes wider in the width direction of the jet boat 10 as the keel 20 extends from the bow of the jet boat 10 to the stern of the jet boat 10. Additionally, the keel 20 preferably extends further below the jet boat 10 as the keel 20 extends from the bow of the jet boat 10 to the stern of the jet boat 10. Additionally, the concave curved sides 22 of the keel 20 preferably become longer and/or more curved as the keel 20 extends from the bow of the jet boat 10 to the stern of the jet boat 10.

As also shown in FIGS. 3 and 4, an articulating keel 30 is attached to a rear of the hull 15 and is arranged to pivot about a pivot axis 35 that extends vertically or substantially vertically. The articulating keel 30 preferably extends rearward behind the keel 20. The articulating keel 30 is mounted to the rear of the hull 15 such that a bottom surface 31 of the articulating keel does not extend below a bottom surface 21 of the keel 20 when the articulating keel 30 is parallel or substantially parallel to the fore and aft direction of the jet boat 10. Accordingly, when the articulating keel 30 is parallel or substantially parallel to the fore and aft direction of the jet boat 10, the articulating keel 30 is protected from being damaged by objects in the water or even the ground when the jet boat is traveling in shallow water. The bottom surface 31 of the articulating keel 30 may be located at a same height as the bottom surface 21 of the keel 20. Alternatively, the bottom surface 31 of the articulating keel 30 may be located at a height that is above the bottom surface 21 of the keel 20.

Figure 5:
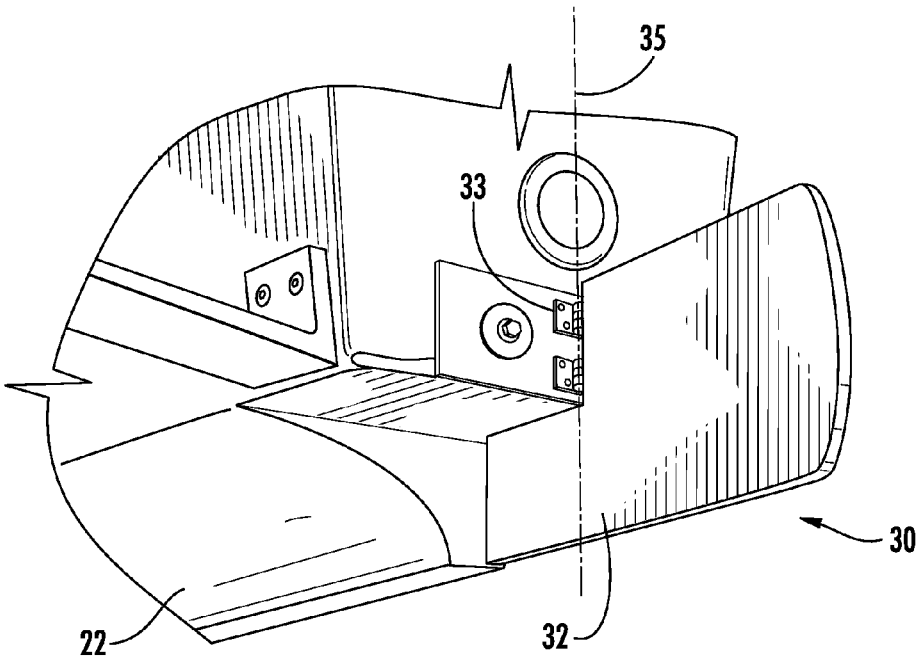
FIG. 5 is a perspective rear view of the stern of the jet boat according to another preferred embodiment of the present invention.

As shown in FIG. 3, the articulating keel 30 is preferably mounted to the hull 15 with a hull bracket 33 such that the articulating keel is pivotable to the left and to the right about the pivot axis 35. In FIG. 3, the articulating keel 30 is attached to the hull 15 such that the pivot axis 35 is located forward of the articulating keel 30. However, the articulating keel 30 can be attached to the hull 15 such that the pivot axis 35 extends through the articulating keel 30, including the foremost edge of the articulating keel 30 or a portion of the articulating keel 30 rearward of the foremost edge. FIG. 5 shows an example of the pivot axis 35 extending through a portion of the articulating keel 30 rearward of the foremost edge articulating keel. As shown in FIG. 5, if the rear-facing surface of the keel 20 is not flush with the rear-facing surface of the hull 15, then the articulating keel 30 can include a portion extending forward of the pivot axis 35 along the hull 15 and towards the rear-facing surface of the keel 20, and the pivot axis 35 can extend through a portion of the articulating keel 30 extending along the hull 15 and towards the rear-facing surface of the keel 20. The articulating keel 30 may be attached to the hull 15 by any other suitable fastener. The articulating keel 30 may have a shape that is flat or substantially flat. That is, the sides 32 of the articulating keel 30 preferably are flat or substantially flat. Alternatively, the articulating keel 30 may have a shape that corresponds to a shape of a rear portion of the keel 20, or any other suitable shape.

When the articulating keel 30 is pivoted to the left or to the right about the pivot axis 35, at least a portion of the bottom surface 31 of the articulating keel is located below the sides 22 of the keel 20. Thus, at least a lower portion of the side surface 32 of the articulating keel 30 can deflect water passing under the sides 22 of the keel 20. Thus, the articulating keel 30 assists in steering the jet boat 10.

Figure 6:
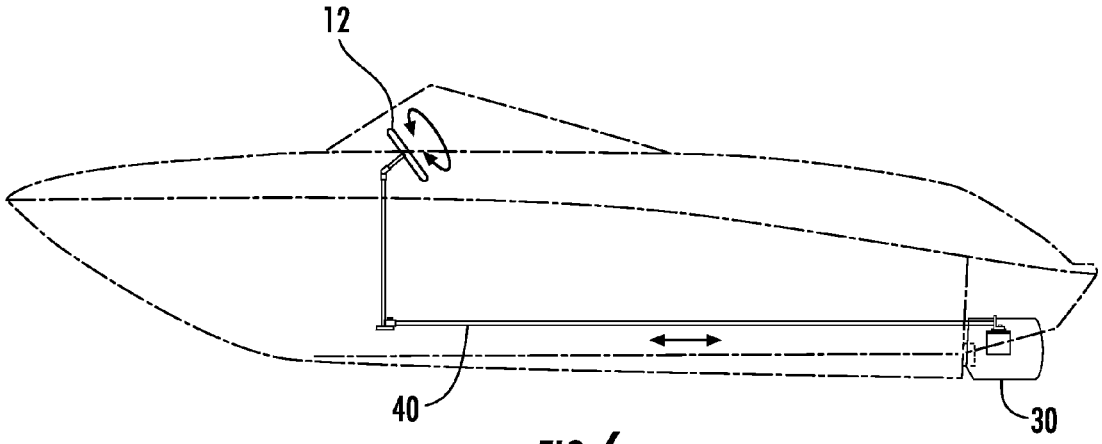
FIG. 6 is a side view of the jet boat according to a preferred embodiment of the present invention.

As shown in FIG. 4, the articulating keel 30 is arranged to be pivoted about the pivot axis 35 using a first lever 41 and a second lever 42. The first lever 41 is preferably connected to a keel bracket 34 mounted on the articulating keel, and the second lever 42 is pivotally connected to the first lever 41. The second lever 42 is connected to a linkage 40 inside the hull 15 to linearly move the second lever 42 and thereby pivot the first lever 41. As shown in FIGS. 1 and 6, the linkage 40 is connected to a steering device 12 in the cockpit of the jet boat 10. The linkage 40 may be a cable or any other known mechanical device that transmits a turning force of the steering device 12 to pivot the articulating keel 30 about the pivot axis 35. Alternatively, the articulating keel 30 may be pivoted using an electric motor or hydraulics that receive a signal from the steering device 12 and an electronic control unit mounted on the jet boat 10.

The steering device 12 may be a steering wheel, or any other suitable device that can be steered by the operator of the jet boat 10. Preferably, the steering device 12 is arranged to simultaneously pivot both the jet propulsion nozzles 11 and the articulating keel 30 to steer the jet boat 10. Alternatively, the jet boat 10 may include an articulating keel steering system arranged to pivot the articulating keel 30 and a separate nozzle steering system arranged to pivot the jet propulsion nozzles 11.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet boat comprising:

a hull including a keel extending in a fore and aft direction of the jet boat;

at least one jet propulsion nozzle mounted to a rear of the hull;

an articulating keel directly attached to the rear of the hull, the articulating keel arranged to pivot about a pivot axis extending vertically or substantially vertically, and a steering system arranged to simultaneously pivot both the at least one jet propulsion nozzle and the articulating keel; wherein a bottom surface of the articulating keel does not extend below a bottom surface of the keel when the articulating keel is parallel or substantially parallel to the fore and aft direction of the jet boat; and the articulating keel is aligned with the keel of the hull in the fore and aft direction of the jet boat.

2. The jet boat according to claim 1, wherein at least a rear portion of the keel includes sides extending upward from the bottom surface of the keel, and when the articulating keel is pivoted to the left or to the right about the pivot axis, at least a portion of the bottom surface of the articulating keel is located below the sides of the keel so as to deflect water passing under the sides of the keel.

3. The jet boat according to claim 2, wherein the sides of the keel are concave curved, and at least the rear portion of the keel has a V-shaped cross-section.

4. The jet boat according to claim 3, wherein the concave curved sides of the keel are longer as the keel extends rearward in the fore and aft direction of the jet boat.

5. The jet boat according to claim 3, wherein the concave curved sides of the keel become more curved as the keel extends rearward in the fore and aft direction of the jet boat.

6. The jet boat according to claim 1, wherein the bottom surface of the articulating keel is located at a same height as the bottom surface of the keel.

7. The jet boat according to claim 1, wherein the bottom surface of the articulating keel is located at a height that is above the bottom surface of the keel.

8. The jet boat according to claim 1, wherein the articulating keel has a shape that is flat or substantially flat.

9. The jet boat according to claim 1, wherein the articulating keel has a shape that corresponds to a shape of a rear portion of the keel.

10. The jet boat according to claim 1, wherein the at least one jet propulsion nozzle includes a first jet propulsion nozzle and a second jet propulsion nozzle mounted to the rear of the hull;

the first and second jet propulsion nozzles are disposed at a port side and a starboard side of the jet boat, respectively; and the articulating keel is disposed in between the first and second jet propulsion nozzles in a width direction of the jet boat.

11. The jet boat according to claim 1, further comprising a hull bracket directly attached to the articulating keel and to the rear of the hull.

12. The jet boat according to claim 1, wherein the steering system includes:

at least one lever attached to the articulating keel;

a linkage connected to the at least one lever; and a steering device connected to the linkage.

13. The jet boat according to claim 12, wherein the linkage includes a cable.

14. The jet boat according to claim 12, wherein the steering device includes a steering wheel.

15. The jet boat according to claim 1, wherein the pivot axis is forward of the articulating keel.

16. The jet boat according to claim 1, wherein the pivot axis extends through the articulating keel.

17. The jet boat according to claim 1, wherein the articulating keel includes a portion that extends forward of the pivot axis.

* * * * *